US007454162B2

(12) United States Patent
Segerer et al.

(10) Patent No.: US 7,454,162 B2
(45) Date of Patent: Nov. 18, 2008

(54) MULTIFUNCTION DEVICE FOR POST-PROCESSING OF A PRINTING SUBSTRATE WEB PRINTED BY AN ELECTROGRAPHIC PRINTING DEVICE

(75) Inventors: Peter Segerer, Olching (DE); Robert Lang, Allershausen (DE); Roland Wolf, Unterhaching (DE); Franz Wittmann, Isen (DE); Said Youzbachi, Munich (DE); Guenther Eder, Munich (DE); Hans-Georg Coufal, Markt Schwaben (DE)

(73) Assignee: Oce Printing Systems GmbH, Poing (DE)

( * ) Notice: Subject to any disclaimer, the term of this patent is extended or adjusted under 35 U.S.C. 154(b) by 246 days.

(21) Appl. No.: 11/007,742

(22) Filed: Dec. 8, 2004

(65) Prior Publication Data

US 2005/0158099 A1 Jul. 21, 2005

(30) Foreign Application Priority Data

Jan. 15, 2004 (DE) ..... 10 2004 002 232

(51) Int. Cl.
*G03G 15/00* (2006.01)

(52) U.S. Cl. ..... 399/407; 399/341

(58) Field of Classification Search ..... 399/407, 399/341

See application file for complete search history.

(56) References Cited

U.S. PATENT DOCUMENTS 3,593,939 A * 7/1971 Bolles ..... 242/413.4
4,236,955 A * 12/1980 Prittie ..... 156/353
4,567,673 A * 2/1986 Bohnensieker ..... 34/392
4,814,219 A * 3/1989 Burgess et al. ..... 428/113
4,920,621 A * 5/1990 Metzen ..... 26/18.6
5,043,318 A 8/1991 Kawakami et al.
5,136,316 A * 8/1992 Punater et al. ..... 347/154
5,264,899 A 11/1993 Mandel
5,407,617 A * 4/1995 Oppermann et al. ..... 264/46.4
5,628,845 A * 5/1997 Murray et al. ..... 156/64
5,642,671 A * 7/1997 Winheim ..... 101/424.1
5,758,227 A * 5/1998 Kopp ..... 399/69
5,805,969 A 9/1998 Elsermans et al.
5,874,164 A * 2/1999 Caldwell ..... 428/306.6
6,249,667 B1 6/2001 Acquaviva et al.

(Continued)

FOREIGN PATENT DOCUMENTS

DE 195 05 982 8/1996

(Continued)

OTHER PUBLICATIONS

Rightlook Your Online Reconditioning Superstore Dec. 7, 2004.

*Primary Examiner*—Anthony H. Nguyen
(74) *Attorney, Agent, or Firm*—Schiff Hardin LLP

(57) ABSTRACT

Changes of properties (for example, dampness, sliding characteristic, gloss) of a printing substrate web caused by a printing of a printing substrate web are corrected by a multifunction device that is arranged at an output of the printing device. In the multifunction device, arranged in succession in the transport direction of the printing substrate web are devices for buffering, for smoothing, for moistening, for cooling, for lubrication and for discharge of the printing substrate web. The devices are executed and adapted to one another such that they can be optionally deactivated by the uses without affecting the functions of the remaining devices.

61 Claims, 9 Drawing Sheets

U.S. PATENT DOCUMENTS

| | | | | |
|---|---|---|---|---|
| 6,259,887 | B1 | 7/2001 | Awano | |
| 6,318,263 | B1 * | 11/2001 | De Vroome | 101/424.1 |
| 6,435,094 | B1 * | 8/2002 | Siler et al. | 101/488 |
| 2001/0017102 | A1 * | 8/2001 | Caldwell | 118/33 |
| 2003/0073269 | A1 * | 4/2003 | Tran | 438/183 |
| 2003/0188647 | A1 * | 10/2003 | Ullrich et al. | 101/226 |
| 2004/0017456 | A1 * | 1/2004 | Obertegger et al. | 347/104 |

FOREIGN PATENT DOCUMENTS

| | | |
|---|---|---|
| DE | 296 23 237 | 3/1998 |
| EP | 0 758 766 | 5/2001 |
| WO | WO 01/98840 | 12/2001 |

* cited by examiner

MULTIFUNCTION DEVICE FOR POST-PROCESSING OF A PRINTING SUBSTRATE WEB PRINTED BY AN ELECTROGRAPHIC PRINTING DEVICE

BACKGROUND

In print media production, after a printing device a more or less elaborate post-processing is often implemented for a printing substrate web, for example a paper web. The finished printer products are there produced from the printing substrate formats used for the printing. Post-processing machines can be, for example, cutters, binders, folders, or stackers.

In electrophotographic printing, the toner images (generated on the printing device in the printing device) of the images to be printer are fixed and thus connected with the printing substrate. This method is known (see WO 01/98840 A2, which is herewith incorporated into the disclosure) and is therefore not explained further here. The fixing can occur in various ways, for example via roller fixing under pressure and heat or via radiation fixing. For the individual techniques, reference is made to the already-cited WO 01/98840 A2. In the fixing, the printing substrate web is thus exposed to heat or pressure, with the consequence that its properties such as, for example, dampness and sliding properties are negatively influenced. In particular, however, poor sliding properties of the printing substrate can lead to the fixed toner layer being mechanically damaged or smeared in the machines of the post-processing. These types of damages can lead to accumulations of toner particles at exposed machine parts, which can in turn lead to unwanted toner deposits on the printing substrate web. From WO 01/98840 A2 it is known to improve the post-processing of the printing substrate web in that the printing substrate web is moistened, such that the loss of dampness caused by the printing is compensated for. Water is normally used as a means for moistening.

In general, however, for an acceptable print quality, contamination, particularly on the printing substrate web, must be prevented at the machines, in particular for the post-processing. However, it is not sufficient to moisten the printing substrate web corresponding to WO 01/98840 A2. Rather, its sliding properties must also be improved.

In the transport of a printing substrate web from an electrographic printing device to post-processing machines, problems occur when the printing substrate web must be transported on the transport path with different speeds. In order to then prevent a web break or too-large web loops of the printing substrate web, reserve buffers are provided for the printing substrate web. An example of this results from U.S. Pat. No. 5,685,471. Between the printing device and post-processing machines (output stacker for the printing substrate web), reserve buffers are necessary in order to have sufficient reserve of printing substrate web upon starting and stopping of the print device in order to be able to correspondingly activate or deactivate (in terms of their functionality) the post-processing machines with temporal decoupling. In particular via the withdrawal for the pages of suitable re-printing necessary in the printing device, in particular in color printing, due to the start launch, a reserve amount of the printing substrate web must be held until the printing speed has been achieved, in order to prevent a tear of the printing substrate web.

It has been proposed to solve this problem with the aid of what is known as a dancing roller, a roller lying on the printing substrate web such that it is freely guided. When, in operation, a slack of the printing substrate web (a sag of the printing substrate web) occurs, this is drawn into the reserve buffer by the weight of the dancing roller and thus a loop is formed.

Further devices with which, for example, properties of the printing substrate web negatively influenced by the printing are corrected are, for example, a smoothing device (glossing device) or a cooling device. The smoothing device is customarily arranged after the fixing station in the printing device (EP 0 758 766 B1) and comprises at least one smoothing roller that is pressed on the printing substrate web. With a cooling device, the printing substrate web can be cooled before this arrives at the post-processing machines. Finally, the printing substrate web must be moved to the post-processing machines with the aid of a transport device.

SUMMARY

An object is to specify a multifunction device with which the requirements that a printed printing substrate web can be optimally post-processed can be met.

A multifunction device is provided for post-processing of a printing substrate web printed by a printing station of an electrographic printing device. After leaving the printing station of the printing device, some or all of the following are provided: a device for buffering the printing substrate web, a device for smoothing of the printing substrate web, a device for moistening of the printing substrate web, a device for cooling of the printing substrate web, a device for lubrication of the printing substrate web, and a device for discharge of the printing substrate web.

DESCRIPTION OF THE PREFERRED EMBODIMENTS

Figure 1:
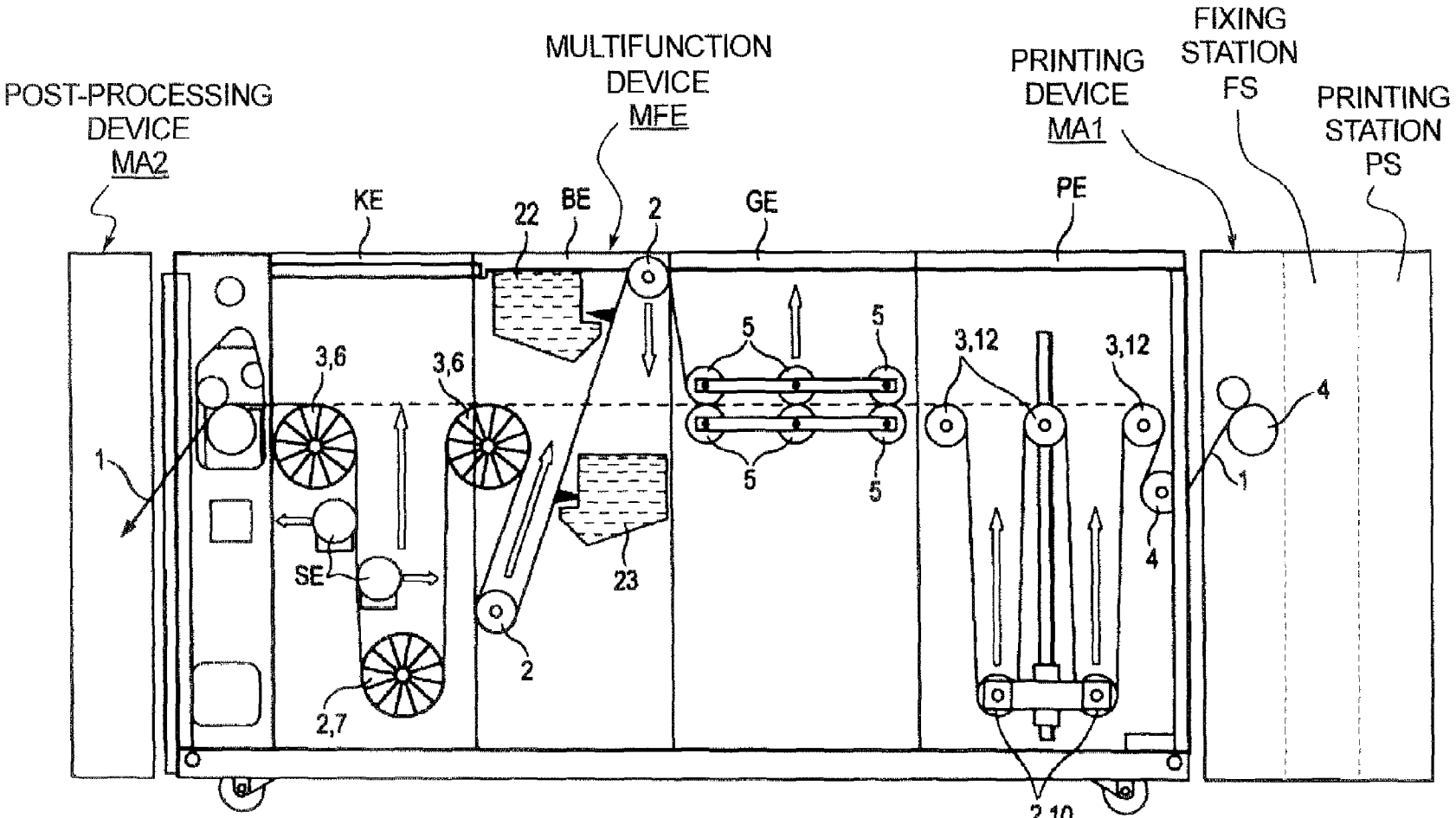
FIG. 1 is a first embodiment of the multifunction device.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

The previously described devices with their various functions are thus combined into a single device, the multifunction device that can be arranged directly behind the printing device and here, for example, behind the fixing station. An optimal sequence of the individual devices is thereby established according to their function. When the buffer device is arranged at a first position along the transport path of the printing substrate web after the printing device, it is achieved that the printing substrate web can be fed to the subsequent devices with continuous speed, i.e. the speed fluctuations due to the printing, and pull-back of the printing substrate web given color printing, no longer have an effect on the function of the subsequent devices. When the smoothing device is arranged after the buffer device, the heat caused by the printing and still present in the printing substrate web can be used. As a next device, a moistening device can be provided that on the one hand somewhat cools the printing substrate web and on the other hand, however, profits from the increased temperature of the printing substrate web, since then the sprayed moistening agent is better absorbed by the printing substrate web. The cooling device in order to be able to supply the cooled printing substrate web to the post-processing machines can subsequently follow. The lubricating or coating device can be arranged after the cooling device, since this has the advantage that the applied lubricant better remains on the surface of the printing substrate web. However, it can also be arranged in the moistening device. At the end of the multifunction device, a discharge device for the printing substrate web is appropriately provided that then can draw the printing substrate web through the multifunction device and therewith can use all previously arranged devices.

Via this reasonable arrangement of the devices along the transport path within the multifunction device, it is then achieved that an optimally conditioned, continuously running printing substrate web is provided to the post-processing machines. The control and device expenditure as well as the space requirement and the expenditure for the initial operation is thus clearly reduced relative to a realization with individual devices.

The devices are adapted to one another such that they can alternatively be deactivated without influencing the function of the remaining devices.

For this, it is advantageous when the devices are designed such that

- in the individual devices, the printing substrate web is directed over fixed deflection rollers that establish the main transport route of the printing substrate web within the device,
- the deflection rollers arranged outside of the main transport route of the printing substrate web are arranged such that they can be shifted in the direction towards the main transport route, such that they can move the printing substrate web in the direction towards the function units of the respective device (device is operable=operation position) or, respectively, in the opposite direction, can move the printing substrate web in the direction towards the main transport route (device is inoperable=rest position).

An exchange of the printing substrate web can then be executed simply in that the displaceable deflection rollers are shifted in the direction of the main transport route of the printing substrate web, such that the printing substrate web takes up a straight transport path through the devices.

The device for lubrication or coating (lubrication device) can alternatively be arranged within the cooling device such that the printing substrate web is initially directed over deflection rollers realized as cooling rollers and then passes by the lubrication device, or the lubrication device can be integrated into the moistening device.

It is advantageous when a buffer device with a reserve buffer for accommodation of a printing substrate web supplied with varying speed in an electrographic print device is executed such that

- an operating means (for example at least one dancing roller) is arranged in the reserve buffer, the operating force of which operating means acts on the printing substrate web in order to form a loop of the printing substrate web,
- sensors scanning the loop are arranged in the reserve buffer that emit sensor signals indicating the length of the loop,
- in which a discharge device that, controlled by the sensor signals, conveys the printing substrate web with continuous speed from the reserve buffer.

Via the sensors, for example light barriers, the discharge device can be controlled such that, in spite of a feed of the printing substrate web with differing speed, for example given start-stop operation of the printing device, the printing substrate web can be transported from the reserve buffer with continuous speed. Post-processing machines can then be used without problems, i.e. they do not have to adapt their operating speed to the speed with which the printing substrate web leaves the printing device.

It is appropriate when three sensors are arranged in the reserve buffer in the loop direction such that the first sensor indicates (first sensor signal) whether the reserve buffer is empty, the second sensor indicates (second sensor signal) whether the loop of the printing substrate web is in the desired position or state, and the third sensor indicates (third sensor signal) whether the reserve buffer is full. These sensor signals can be supplied to a buffer controller that controls the discharge device such that the loop of the printing substrate web fluctuates around the desired position.

The buffer controller can furthermore regulate the discharge device such that,

- this operates with higher speed when the third sensor indicates (with the third sensor signal) that the reserve buffer is full, and maintains this speed until the second sensor indicates that the loop is in the desired position,
- this operates with lower speed when the first sensor indicates (with the first sensor signal) that the reserve buffer is empty, and maintains this speed until the second sensor indicates that the loop has reached the desired position,
- this operates with median speed, dependent on the operating mode of the printing device, when the second sensor indicates that the loop is in the desired position.

The median speed essentially depends on the operating mode of the printing device. The speed fluctuations of the printing substrate web occurring in operation can be intercepted by the buffer controller that regulates the discharge device such that a) this initially operates with median initial speed, dependent on the operating mode, upon the loop of the printing substrate web reaching the desired position, b) given an under-run of the desired position by the loop in the direction towards the third sensor, the speed is increased until the loop of the printing substrate web crosses the desired position in the direction towards the first sensor, and then the speed is lowered again, c) step b) is implemented until the duration in which the loop is located over the desired position coincides with the duration in which the loop is located below the desired position, and the speed then achieved is maintained as an average operating speed.

At the beginning of the printing, the buffer controller controls the discharge device such that, after the start, the discharge device starts after a delay and operates with the speed that corresponds to the average initial speed.

For regulation of the sliding properties of a print substrate web, a moistening device can be provided that applies on the printing substrate web a moistening agent made from a moistening fluid and a lubricant dissolved therein. An improvement of the sliding properties of the printing substrate web is thus additionally achieved with a moistening device that can be used to supplement the dampness of the printing substrate web. For this, only a different moistening agent, comprised of the moistening fluid and the lubricant dissolved therein, has to be added to the moistening device.

All agents that, applied to the printing substrate web, lead to an improvement of the sliding properties of the printing substrate web can be used as a lubricant. Advantageous lubricants are, for example, silicon oil and lubricants based on silicon oil. For example, wax or a polymer can be added to the silicon oil as additives, and from this an emulsion can be formed. Furthermore, the use as lubricants used for cooling in drills for metal processing is possible. These can be based on a mineral, vegetable or synthetic base.

The proportion of lubricant in the moistening agent depends on the type of the printing substrate web. For each printing substrate, a special moistening agent can be provided. The proportion of lubricant can thereby be measured, for example via determination of the electrical conductivity of the moistening agent that depends on the proportion of the lubricant in the moistening agent. With this measurement result, the correct moistening agent can be adjusted per printing substrate web.

Upon changing a printing substrate web in the printing device, a different moistening agent must normally also be used. In order to already have no problems with an incorrectly adjusted moistening agent at the beginning of the print, it is appropriate to remove the previous moistening agent from the moistening device before the new moistening agent is poured into the moistening device. It is advantageous when the device is designed such that the cleaning of the moistening device is automated.

The moistening device can comprise one or more rotor nebulizers or atomizers or spray nozzles.

In a second embodiment, the moistening device can comprise a roller arrangement with at least one application roller for the moistening means that is arranged on one side of the printing substrate such that it can print on the printing substrate, with an application element, associated with the application roller, that can be pivoted onto the application roller and transfers the moistening agent onto the application roller, and with a counter-element on the side of the printing substrate lying opposite the application roller.

The counter-element can be a further application roller with an associated further application element, such that the printing substrate can be moistened on both sides.

It is appropriate when the application roller is freely movable and is entrained or taken along by the printing substrate. An additional actuator or drive is then unnecessary.

It is advantageous when the pivoting device of the application roller for the printing substrate and the pivoting device of the application element for the application roller lie approximately perpendicular to one another. The movements of application roller and application element are then decoupled from one another and can be separately adjusted.

To generate the pivot movement of the application roller, this can be borne on a first linkage lever that, for its part, is positioned in a housing. A first pressure element that exerts a force on the first linkage lever, and therewith on the application roller in the direction towards the printing substrate web, can be arranged between the housing and the first linkage lever. Furthermore, the application element can be borne on a second linkage lever that is, for its part, is positioned on the housing. A second pressure element that exerts a force on the second linkage lever, and therewith on the application element in the direction towards the application roller, can be arranged between housing and second linkage lever.

The force of the pressure elements can be individually adjusted. This can occur via a spring.

In order to be able to moisten the entire printing substrate web, it is appropriate to adapt (in terms of their width) the respective application roller and the respective application element to the width of the printing substrate web, and to arrange application roller and application element at both ends in linkage levers on which the pressure elements engage.

The application element can comprise a feedthrough and a distributor channel with a distributor gap towards the application roller. When the distributor gap is narrowed in comparison with the distributor channel, the moistening agent can be accelerated and evenly applied on the application roller.

When a conveyor system that supplies the moistening agent to the application element is connected at the feedthrough, it is appropriate to arrange the conveyor system below the application element. Given operation pauses, it is thereby prevented that moistening agent arrives at the application roller.

The second embodiment can also be used only to lubricate or to coat the printing substrate web. It is then appropriate to arrange the lubrication device within or after the cooling device, since it is thereby achieved that the lubricant applied on the printing substrate web remains on the surface of the printing substrate web. Thus with the multifunction device properties of the printing substrate web can be adjusted according to the desire of the user. Worsening of the properties of the printing substrate web caused by the printing can thereby also be remedied again.

Figure 2:
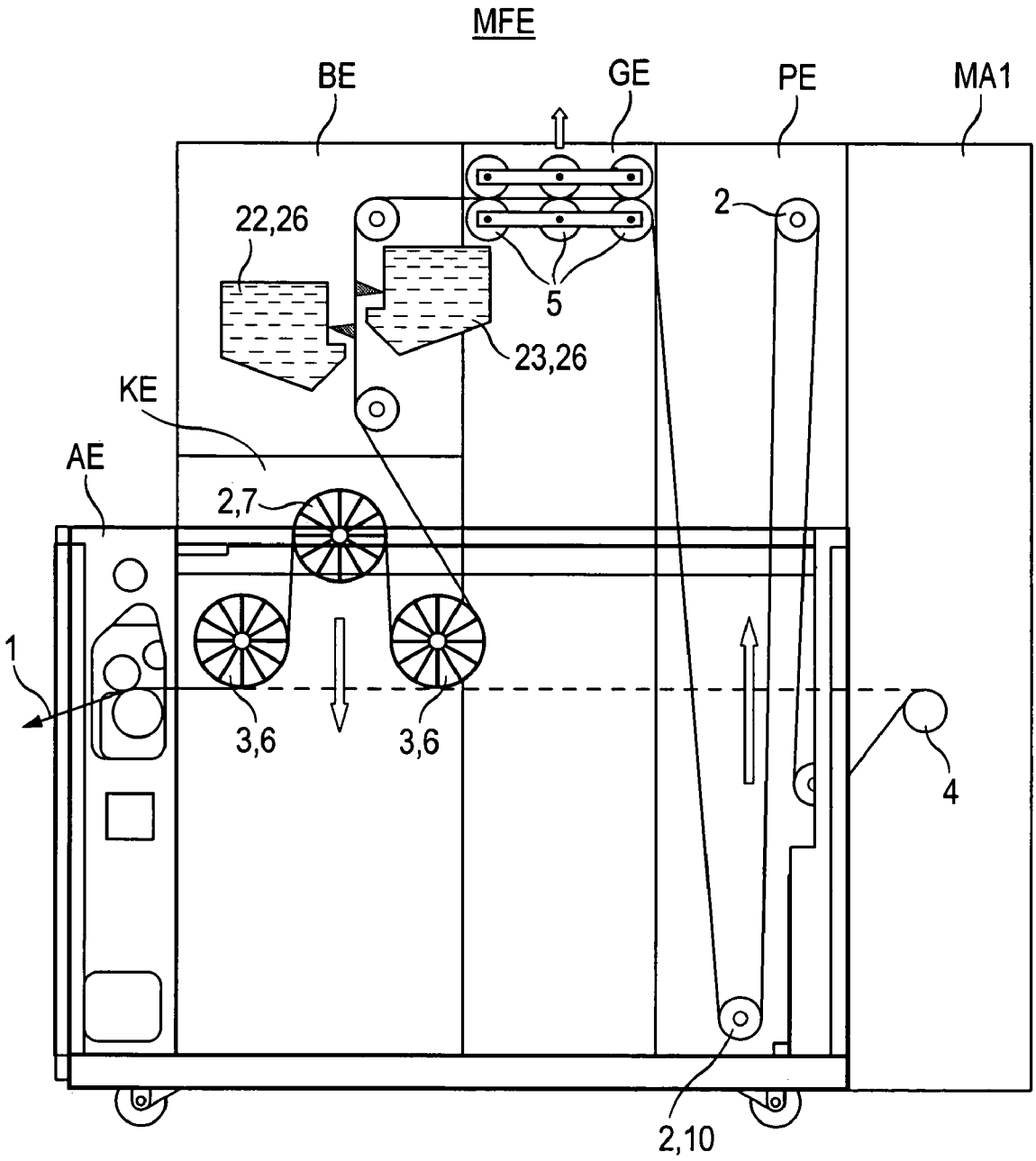
FIG. 2 is a second embodiment of the multifunction device.

FIGS. 1 and 2 respectively show a preferred embodiment. The multifunction device MFE is realized as a single device that, for example, can be borne as a whole by rollers. The multifunction device MFE can be arranged adjacent to an electrographic printing device MA1 (In FIG. 1 indicated by the block MA1) having a printing station PS and a fixing station FS or be integrated into the printing device, for example at the output of the fixing station.

Viewed in the transport direction of the printing substrate web, the multifunction device MFE comprises successive devices that serve to achieve an improvement with regard to the properties of the printing substrate web 1 such as, for example, dampness, sliding capability, and/or gloss.

Viewed in the transport direction of the printing substrate web 1 from the printing device MA1 to a post-processing machine MA2, the design of the multifunction device MFE is as follows:

After the printing device MA1, a buffer device PE for the printing substrate web 1 follows whose task is house a sufficient reserve of printing substrate web 1 in order to be able to continuously deliver printing substrate web 1 without interruption to the following and post-processing devices and machines MA2. Differences in the speed with which the printing substrate web 1 is moved from the printing device MA1 to the multifunction device MFE are thus absorbed by the buffer device PE.

A smoothing device GE subsequently follows with which the surface of the printing substrate web 1 can be smoothed and its gloss is applied.

At the output of the smoothing device GE, a moistening device BE is arranged via which the dampness of the printing substrate web can be adjusted.

A cooling device KE with which the printing substrate web 1 can be cooled follows the moistening device BE, such that the printing substrate web 1 can not be damaged on the surface (toner image) by the post-processing machines MA2.

After the cooling device KE, a lubrication device SE can be arranged (FIG. 1) that sprays the surface of the printing substrate web 1 with a lubricant, such that the sliding properties of the printing substrate web 1 are improved again. The lubrication device SE can also be combined with the moistening device BE (FIG. 2).

At the end of the multifunction device MFE, a discharge device AE is finally arranged that draws the printing substrate web 1 through the multifunction device MFE and is shared for all devices PE, GE, BE, KE, SE lying in front of it. The post-processing machines MA2 can then follow the discharge device AE.

In FIG. 1, the individual devices PE, GE, BE, KE, SE are arranged next to one another. The printing substrate web 1 is thereby directed through the multifunction device MFE over movable deflection rollers 2 and fixed deflection rollers 3 such that, in the functionless state of the devices PE, GE, BE, KE, SE, the printing substrate web 1 is directed through the multifunction device MFE on a straight path (shown dashed=rest position of the movable deflection rollers 2=main transport route of the printing substrate web 1). When the individual devices PE, GE, BE, KE, SE are activated, the printing substrate web 1 can be shifted into the devices PE, GE, BE, KE, SE by the movable deflection rollers 2, such that these can execute their functions (the path of the printing substrate web 1 is shown unbroken=operating position of the movable deflection rollers 2 and of the function modules of the devices PE, GE, BE, KE, SE influencing the printing substrate web 1). Due to this design of the path of the printing substrate web 1 through the multifunction device MFE, an exchange of the printing substrate web 1 is easily possible since it can be extracted from the multifunction device MFE when the movable deflection rollers 2 have been shifted into their rest position. The threading or mounting of the printing substrate web 1 is likewise simplified. A further advantage of this design is that each individual device PE, GE, BE, KE, SE can be deactivated without having to be removed from the multifunction device MFE, in that the associated movable deflection rollers 2 are driven into rest position and the respective function modules of the devices PE, GE, BE, KE, SE are deactivated. The respective device can remain in the multifunction device MFE since it is ensured that it can no longer influence the printing substrate web 1. The user can thus configure the multifunction device MFE according to his desire.

The embodiment of FIG. 2 differs from that of FIG. 1 in that the individual devices PE, GE, BE, KE, SE are not arranged next to one another, but rather follow one another at an optimally narrow space. Thus the smoothing device GE and the moistening device BE are arranged displaced upwards from the remaining devices PE, KE, AE. The advantage of this configuration of the multifunction device MFE is the lower space requirement. A further difference is that the lubrication device SE has been combined with the moistening device BE.

In FIGS. 1 and 2, the printing substrate web 1 is supplied over rollers 4 arranged in the printing device MA1.

In the following, the buffer device PE and the moistening device BE are shown in detail, combined with the lubrication device SE, while the smoothing device GE and the cooling device SE are only explained briefly, since these can be of typical design.

Figure 3:
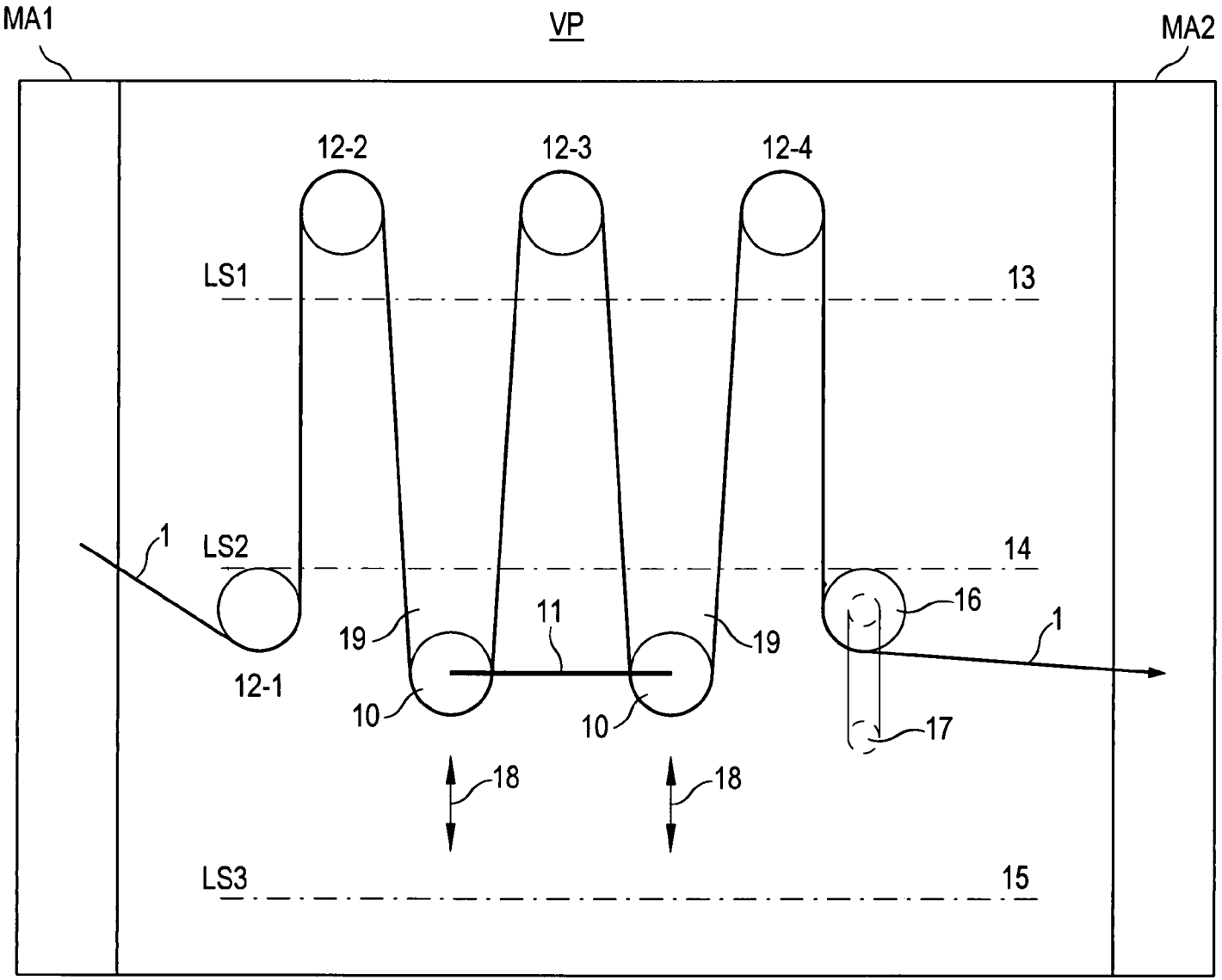
FIG. 3 is an embodiment of the reserve buffer for the printing substrate web.
Figure 4:
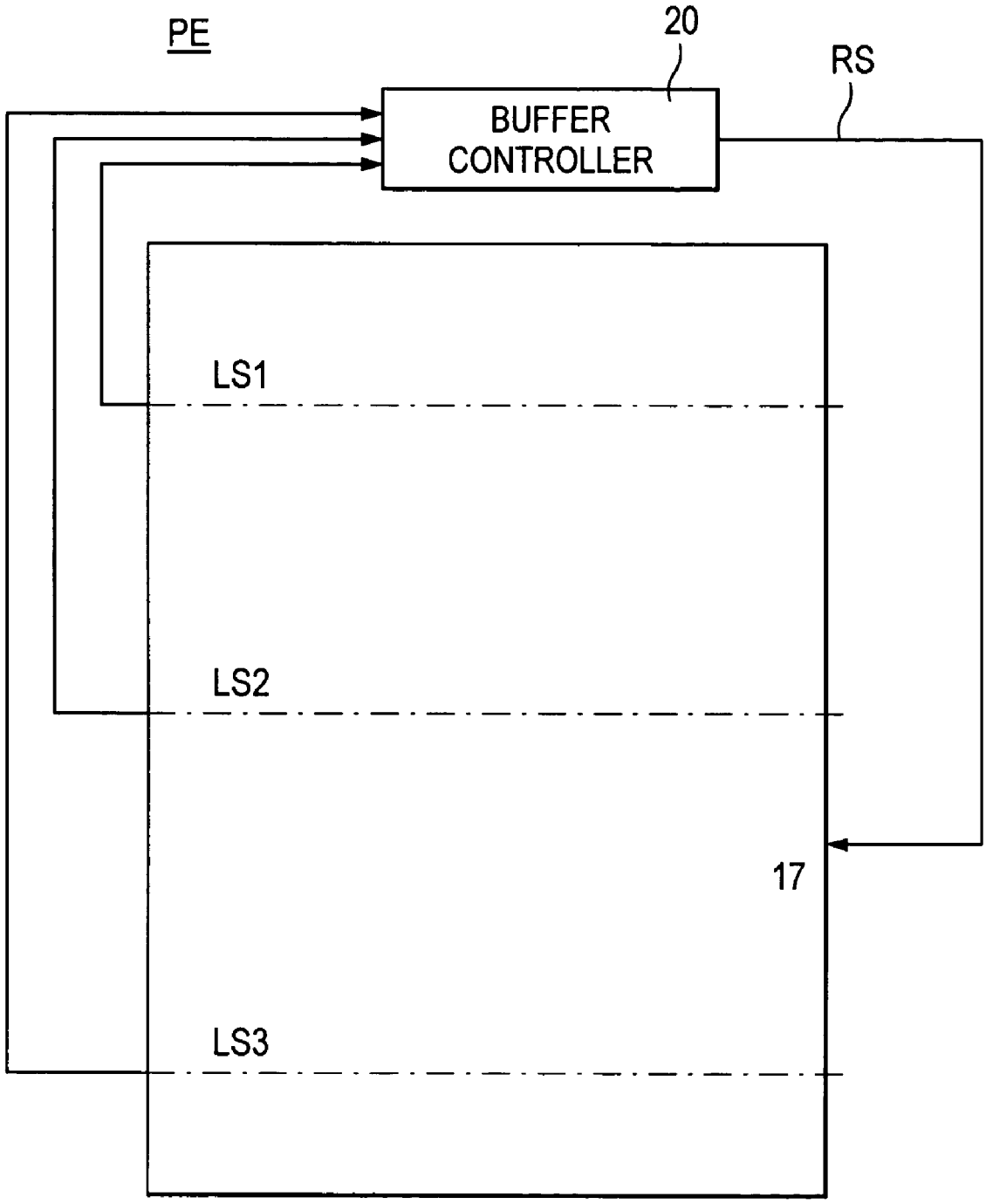
FIG. 4 is a principle arrangement of the buffer device made up of reserve buffer and buffer controller.

FIG. 3 shows a reserve buffer VP for a printing substrate web 1 as a part of a buffer device PE that is shown in FIG. 4. The reserve buffer VP ensures that the printing substrate web 1 is fed with continuous and optimally equal speed to a post-processing machine MA2, for example a spooling roller. The post-processing machine MA2 can then be operated with constant speed, and thus requires no elaborate controller.

The reserve buffer VP comprises an operating device as a function module, for example dancing rollers 10, for example two dancing rollers in FIG. 3, that can be rigidly coupled with a frame 11 such that they execute a movement in the same direction. The printing substrate web 1 is supplied to the reserve buffer VP via a movable first deflection roller 12-1 and deflected into the reserve buffer over further fixed deflection rollers 12-2, 12-3, 12-4. Respectively one dancing roller is arranged between the deflection rollers 12-2 and 12-3 and 12-4. When the printing substrate web 1 is supplied to the reserve buffer VP, via their weight the dancing rollers 10 draw the printing substrate web 1 into the reserve buffer VP and form loops 19. The size of the loops 19 depends on at which speed a discharge device 16 (corresponding with the discharge device AE in FIG. 1) with a motor 17 draws the printing substrate web 1 from the reserve buffer VP. When more printing substrate web 1 is delivered into the reserve buffer VP than is conveyed from the reserve buffer VP by the discharge device 16, the loop 19 wanders into the reserve buffer VP and becomes longer; in the reverse case, the loop 19 is shortened. The dancing rollers 10 are arranged such that they can be shifted in the arrow direction 18.

It is now a goal to ensure, independent of the rate of the feed of printing substrate web 1 into the reserve buffer VP, that the discharge device 16 always draws the printing substrate web 1 at a nearly constant speed from the reserve buffer VP. In order to achieve this goal, sensors, advantageously three sensors, are arranged in the reserve buffer VP. A first sensor 13 is arranged such that it indicates with its sensor signal LS1 whether the reserve buffer VP is empty, thus the end of the loop 19 has passed by the sensor 13 or not. A second sensor 14 indicates with a second sensor signal LS2 when the end of the loop 19 runs past the sensor 14; the sensor signal LS2 thus indicates whether the loop is in the desired position. Finally, a third sensor 15 indicates with a sensor signal LS3 whether the end of the loop 19 passes the sensor 15, thus whether the reserve buffer VP is full or not.

The sensor signals LS1 through LS3 are fed to a buffer controller 20 (FIG. 4) that regulates (dependent on the sensor signals LS1 through LS3) the discharge device 16, thus its motor 17, such that the end of the loop 19 fluctuates around the desired position. It is thereby ensured that sufficient printing substrate web 1 is always contained in the reserve buffer VP, such that printing substrate web can be drawn from the reserve buffer VP with continuous speed without the "empty" state (indicated by the sensor signal LS1) of the reserve buffer VP being able to occur. The buffer controller 20 can be a microprocessor of typical design that is programmed such that it (dependent on the sensor signals LS1 through LS3) emits a control signal RS that is supplied to the motor 17 that transports the printing substrate web 1 from the reserve buffer VP with a speed for which the above-illustrated behavior results.

Figure 5:
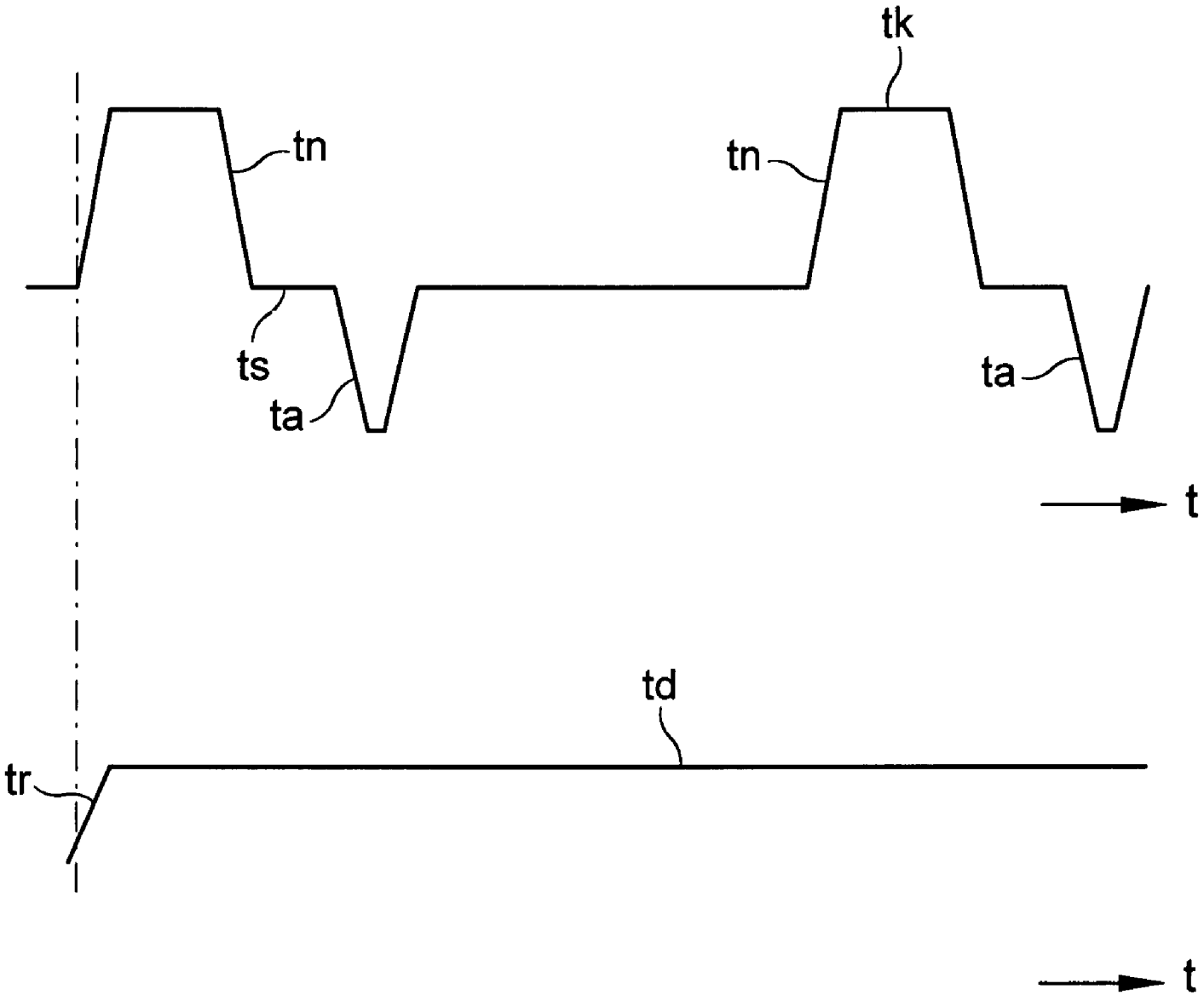
FIG. 5 shows the curve of the movement of the printing substrate web given start-stop operation at the input of the reserve buffer (upper curve) and the curve of the movement of the printing substrate web at the output of the reserve buffer (lower curve)

Curves result from FIG. 5 that show the speed of the printing substrate web 1 plotted over time t at the input of the reserve buffer VP (upper curve) and at the output of the reserve buffer VP (lower curve). From FIG. 5 it is visible that the printing substrate web 1 is fed to the reserve buffer VP at significantly varying speed; for example, there are standstill times ts and times tn in which the speed rises or falls according to a ramp and times tk in which the speed is constant and times ta in which the speed is negative, thus printing substrate web 1 is pulled back from the reserve buffer VP. This very different behavior in the movement of the printing substrate web 1 at the input of the reserve buffer VP must now be compensated by a regulated operation of the discharge device 16 and be converted into a movement of the printing substrate web 1 corresponding to the lower curve. The discharge device 16 is regulated such that at the beginning of the operation the speed of the discharge device 16 increases (ramp tr) and then remains approximately constant (curve td).

Figure 6:
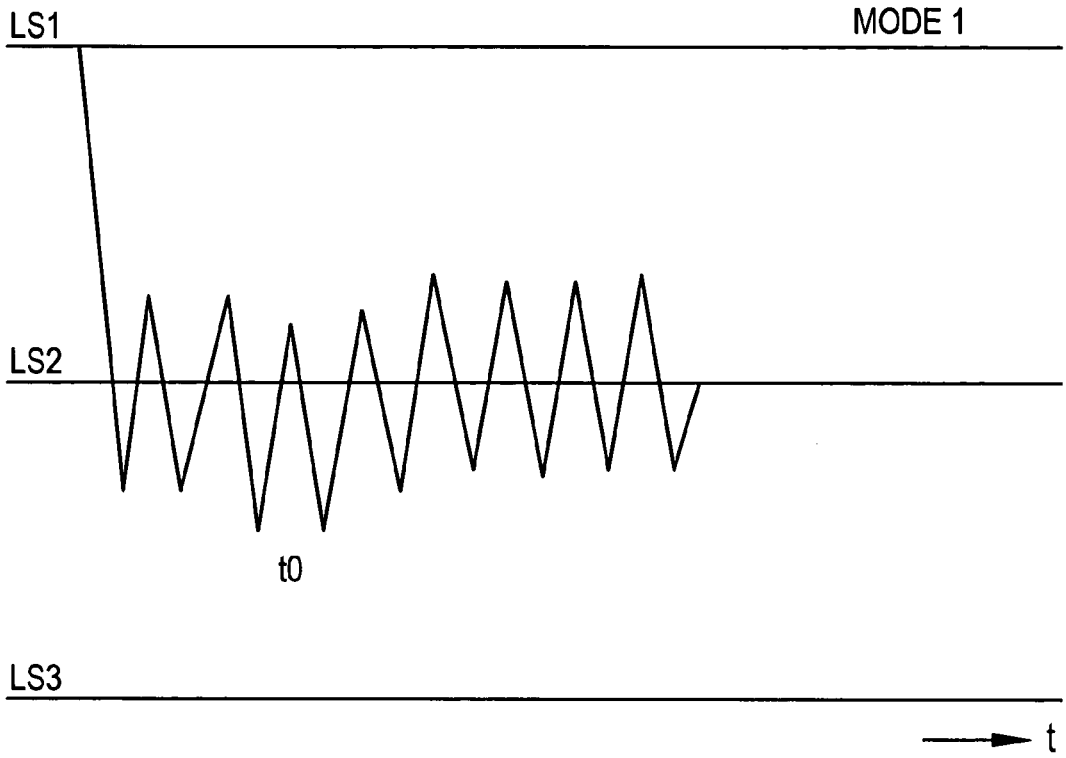
FIG. 6 is a diagram of the movement of the dancing rollers in a first operating mode of the printing device.

The behavior of the dancing rollers 10 in the reserve buffer VP results from FIG. 6, when the printing device operates in a first operating mode (for example mode 1) and printing substrate web 1 is fed to the reserve buffer VP corresponding to FIG. 5, upper curve. If the reserve buffer VP is initially empty, the dancing rollers 10 are located in the "empty" position in the buffer. The discharge device 17 operates with a delay with an average start speed dependent on the operating mode. The result is that the dancing rollers 10 migrate into the reserve buffer VP as long as they (and with them the end of the loop 19) pass by the sensor 14 and cover this (indicated by the sensor signal LS2). If the dancing rollers 10 run downwards past the sensor 14 and under-run the desired position, dependent on the sensor signal LS2 the speed of the discharge device 16 is increased until the dancing rollers 10 again cross the sensor 14 and the sensor signal LS2 therewith changes again. The dancing rollers 10 are then again located above the desired position. Now the speed is lowered. The result of this regulation of the discharge device 16 is that the dancing rollers 10 pivot around the desired position. The speed of the discharge device 16 is only no longer changed when the duration in which the dancing rollers 10 are located above the desired position coincides with the duration in which the dancing rollers 10 are located below the desired position. The speed of the discharge device 16 then achieved establishes the average operating speed of the discharge device 16.

When, in the same operating mode printing substrate web 1 of a different format is printed, the relationships in the feed of printing substrate web 1 to the reserve buffer VP changes. FIG. 6 shows this at t0. The result of this change is that the dancing rollers 10 wander over or under the desired position, and the average operating speed must be changed. The procedure corresponds to the operating method specified above, i.e. the speed of the discharge device 16 is increased or decreased until the duration of the dancing rollers 10 above the desired position and below the desired position is the same again. The speed that has then been set is further used as an operating speed.

Figure 7:
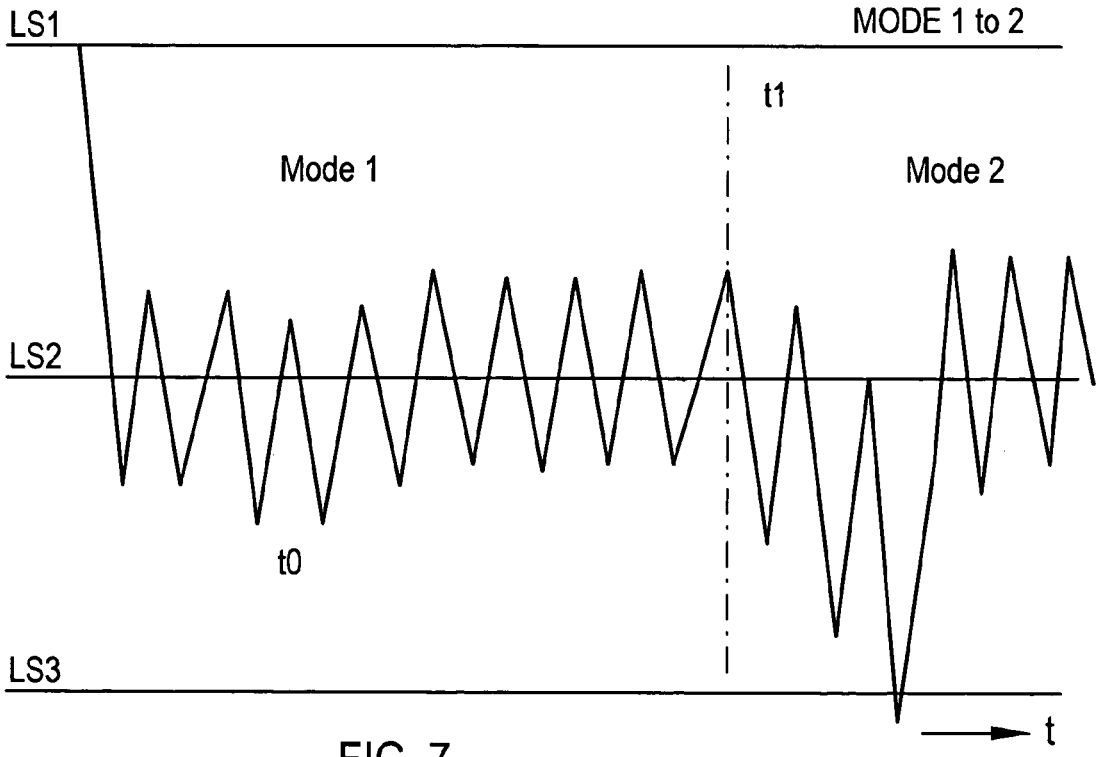
FIG. 7 is a diagram of the movement of the dancing rollers given a change of the operating mode of the printing device.

From FIG. 7, the case results that in the print operation the operating mode is changed with the result that the supply of printing substrate web 1 in the reserve buffer VP significantly changes. Initially in the first operating mode (mode 1) operated as in FIG. 4. The adapting behavior of the discharge device 16 corresponds to that in FIG. 6. At the point in time t1, the operating mode of the printing device is changed (from mode 1 to mode 2). In the example, more printing substrate web is transported into the reserve buffer VP. Since the operating speed initially remains the same, the dancing rollers 10 (and therewith the loop 19) wander downwards in the reserve buffer VP until the dancing roller 10 cover the sensor 15, such that the sensor changes the sensor signal LS3. Due to this, the buffer controller 20 significantly increases the speed of the discharge device 16 until the dancing rollers 10 again cross over the sensor 14 and this changes the sensor signal LS2. The discharge device 16 subsequently operates further with an average operating speed, adapted to the new operating mode (mode 2) that is corrected in the further course as this has been shown in FIG. 6. The behavior of the buffer device PE is corresponding when the change of the operating mode leads to less printing substrate web 1 being fed into the reserve buffer VP. The dancing rollers 10 then cross the sensor 13, this altering the sensor signal LS1 with the result that the buffer controller 20 lowers the speed of the discharge device 16 until the dancing rollers 10 under-run the desired position. The adjustment of the average operating speed in the discharge device 16 then occurs again.

With this regulation of the discharge device 16, it is thus achieved that a reserve of printing substrate web 1 is always present in the reserve buffer VP that is sufficient in order to ensure a continuous delivery of printing substrate web 1 to a subsequent device MA2. These post-processing machines MA2 can operate without being deactivated and are thus decoupled from operation of the printing device and require no elaborate control.

The smoothing device GE with which the surface of the printing substrate web is smoothed and provided with gloss comprises as a function module a plurality of smoothing rollers 5 lying one after the other between and through which the printing substrate web 1 is directed. The smoothing rollers can thus be designed as it is described in EP 0 758 766 B1. They are heated and pressed on the printing substrate web 1. The surface of the printing substrate web 1 is thereby smoothed.

Figure 8:
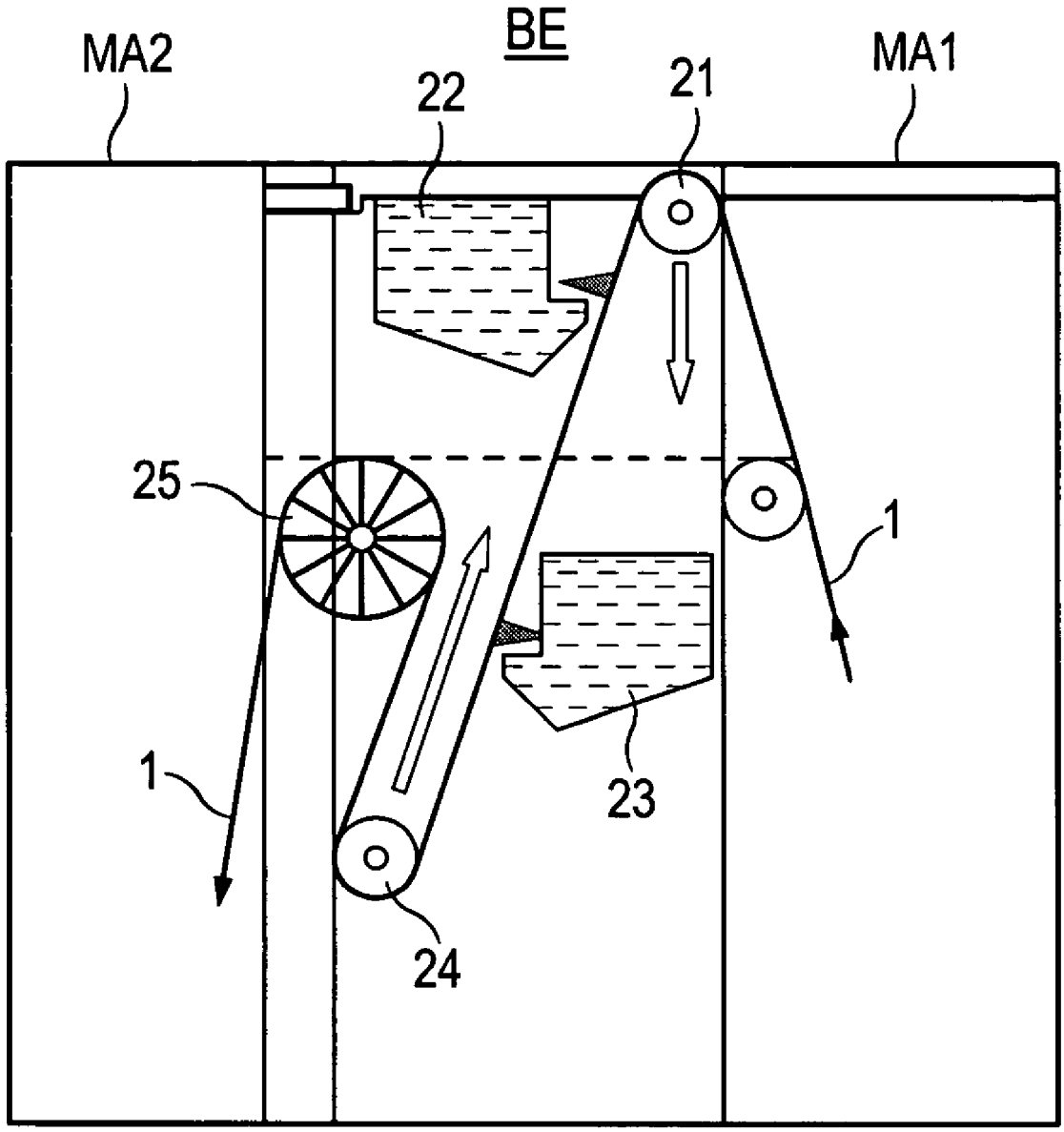
FIG. 8 is a principal representation of a first moistening device.

FIG. 8 shows a first embodiment of the moistening device BE in principle representation. The printing substrate web 1 is moved via a deflection roller 21 into the moistening device BE. In the exemplary embodiment, two moistening modules 22 and 23, respectively one on each side of the printing substrate web 1, are arranged as a function module in the moistening device BE. Each side of the printing web 1 can therewith be charged with a moistening unit. However, it is also possible to provide only one moistening module on one side of the printing substrate web 1. Furthermore, a further deflection roller 24 is arranged such that the printing substrate web 1 stretched on the moistening modules 22, 23 can be moved past. Finally, a deflection roller 25 via which the printing substrate web 1 can be fed to the cooling device KE can be arranged at the output of the moistening device BE. The deflection rollers 21, 24 can be shifted in a direction relative to one another, and therewith relative to the main transport route.

The moistening modules 22, 23 can be built in a known manner. They can, for example, be realized as a rotor nebulizer as they are disclosed in DE 41 36 878 C2. With such a rotor nebulizer, the moistening agent can be sprayed on the printing substrate web 1. Since the moistening agent comprises both a moistening fluid and a lubricant, the printing substrate web 1 is both moistened in order to adjust its dampness and the sliding capability is increased. The printing substrate web 1 can subsequently be further processed again without, for example, the unwanted deposits (described above) of toner being able to occur on the post-processing machines MA2. A worsening of the print quality is also prevented. The moistening modules can also be realized as spray nozzles.

In order to achieve both described advantages, the moistening means is composed of two components: a moistening fluid, for example water, and a lubricant. The lubricant must thereby be soluble in the moistening fluid. Examples for such lubricants are: silicon oil; silicon oil with additives such as wax or a polymer; mineral, vegetable or synthetic oils as they are used for cooling of drills.

Since the printing substrate webs 1 can exhibit different properties with regard to dampness and sliding capability, it is appropriate to provide different moistening agents corresponding to the printing substrate webs 1 to be printed. For this it is necessary to adapt the proportion of lubricant in the moistening agent to the printing substrate web 1. An example of a proportion of lubricant in relation to the moistening fluid can be 1 to 10.

The proportion of the lubricant in the moistening agent can, for example, be determined via the electrical conductivity of the moistening agent, which depends on the proportion of the lubricant. The moistening agent associated with a printing substrate web can naturally also be empirically determined.

Figure 9:
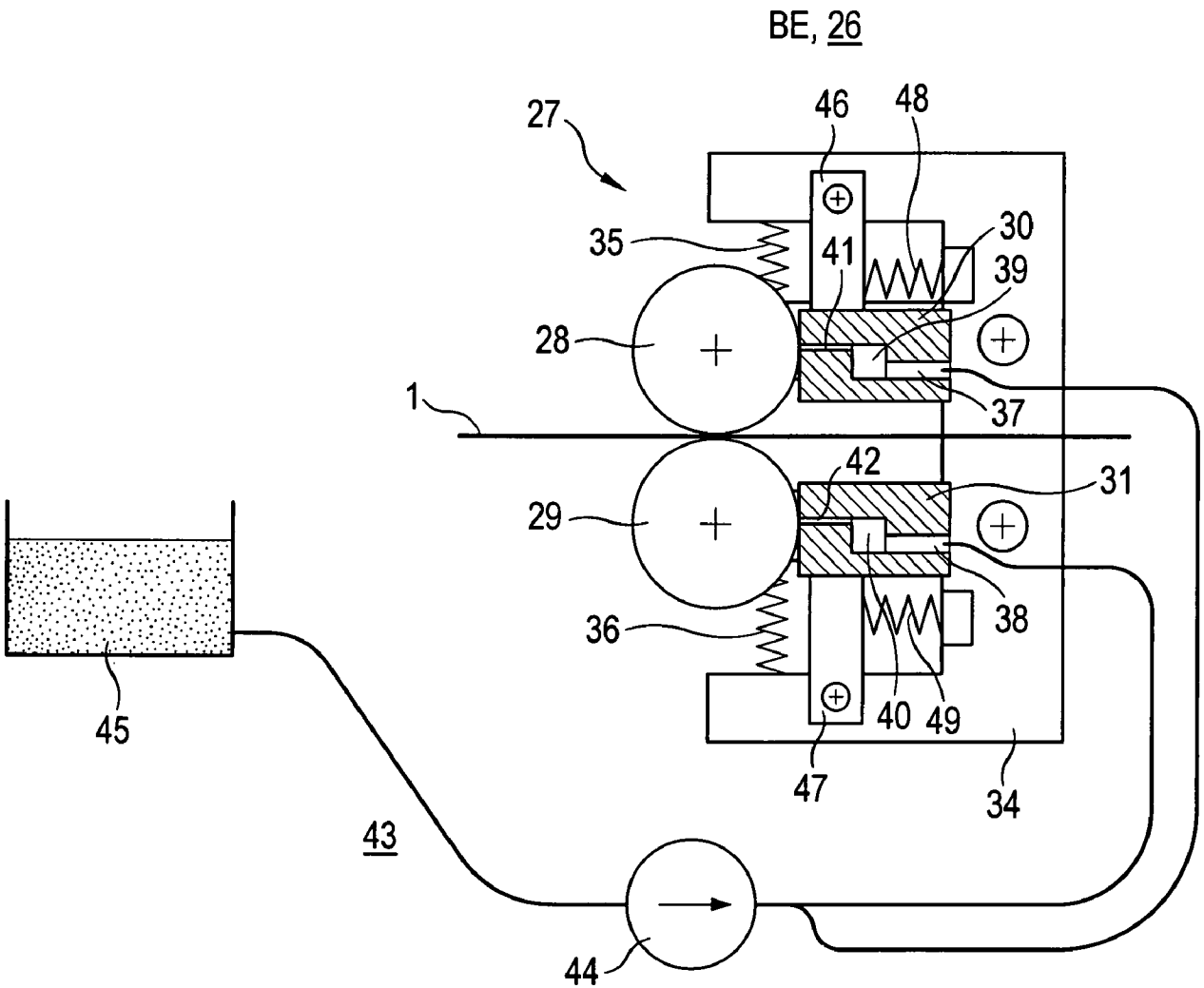
FIG. 9 is a representation of a second moistening device with a roller arrangement in front view.
Figure 10:
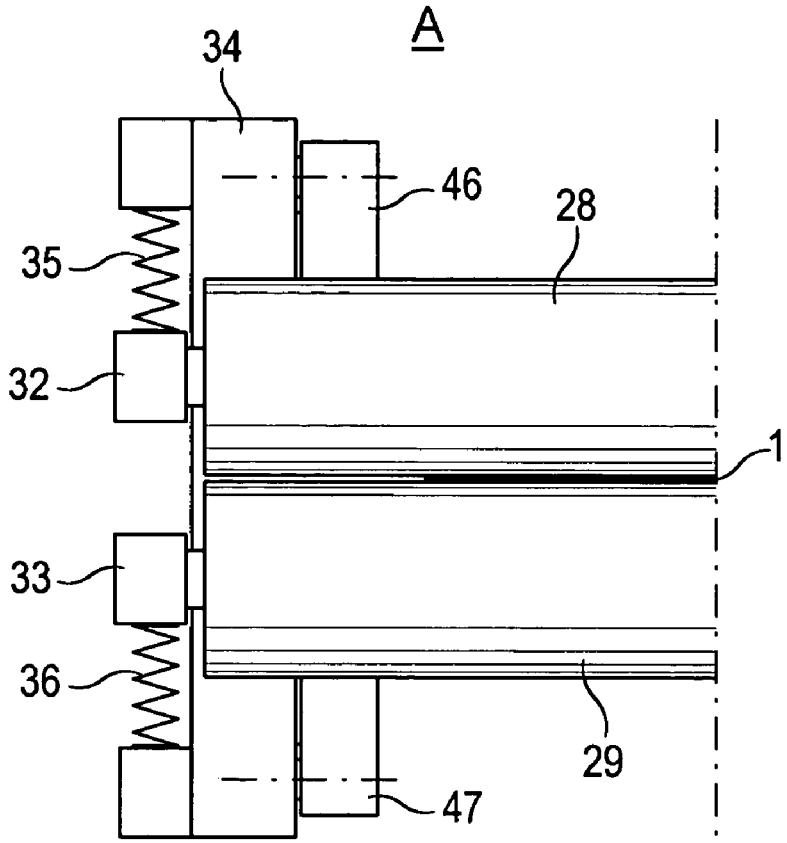
FIG. 10 shows the moistening device according to FIG. 9 in side view (perspective A)
Figure 11:
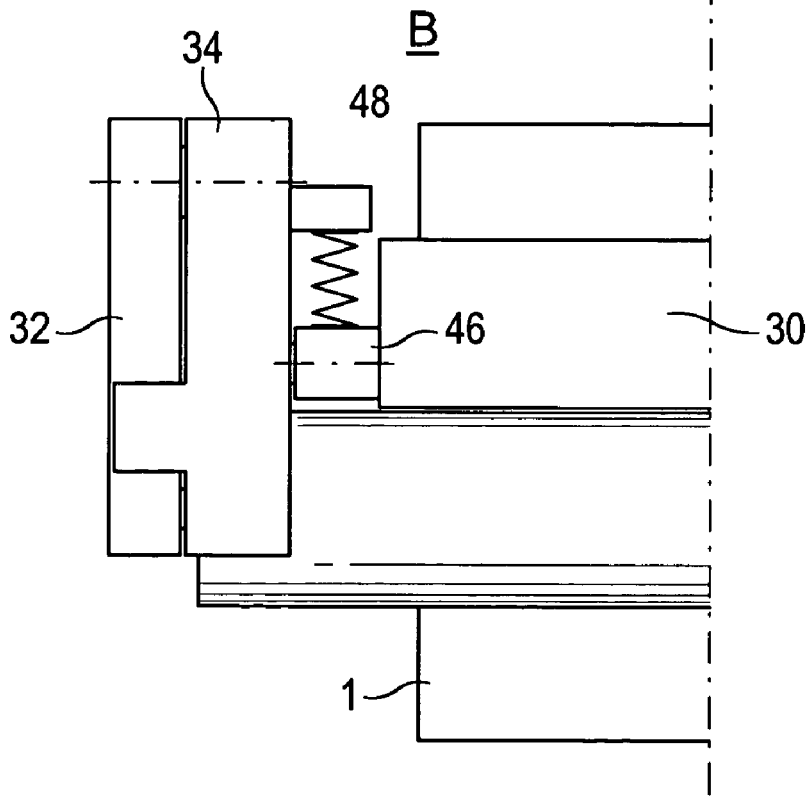
FIG. 11 is a view from above (perspective B), respectively in half-representation.

FIGS. 9 through 11 show a further moistening device 26 that, as a function module, is realized as a roller arrangement 27. In the exemplary embodiment, application rollers 28, 29 for supply of the moistening agent are arranged on both sides of the printing substrate web 1, which application rollers can, however, be identically designed and which are dealt with together in the following.

The moistening device 26 thus comprises application rollers 28 or 29 in order to be able to moisten the printing substrate web 1 on both sides. When the printing substrate web 1 should only be moistened on one side, one application roller is sufficient. It is then appropriate to arrange a counter-element, for example a rod, on the other side of the printing substrate web 1, against which the application roller presses the printing substrate web 1.

The application rollers 28 or 29 are borne on a first linkage lever 32 or 33 that, for its part, are positioned in a housing 34. A force acts on the linkage lever 32 or 33 in the direction towards the printing substrate web 1. This force can be realized with the aid of a spring 35, as shown in FIGS. 2 through 4. However, it is also possible to realize the force with a hydraulic, pneumatic force element or via a weight. It is thus ensured that the application rollers 28 or 29 bear on the printing substrate web 1.

The moistening of the application rollers 28 or 29 with the moistening agent occurs with the aid of the application elements 30 or 31, which comprise a feedthrough, 37 or 38 and a distributor channel 39 or 40 with a distributor gap 41 or 42. The moistening agent is supplied to the application element 30 or 31 via a conveying system 43 that, for example, can comprise a pump 44 and a reservoir 45. The moistening agent is supplied by the conveying system 43 to the feedthrough 37 or 38 and arrives from there into the distributor channel 39 or 40 and the distributor gap 41 or 42. Given small application quantities, the dosing occurs via the capillary effect of the distributor gap 41 or 42. The distributor gap 41 or 42 can also be equipped with a permeable material (such as, for example, a fleece, wick, sintered material) to improve the capillary effect. Given larger application quantities of moistening agent, the pressure of the conveying system 43 can be adjusted such that a specific fluid quantity is set based on the current resistance of the distributor gap 41 or 42. It is thus important that the current resistance of the distributor gap 41 or 42 is clearly larger than the other current resistances in the feed for the moistening agent. When the pump 44 and the reservoir 45 are arranged below the application elements 30 or 31, this has the advantage that the moistening agent flow ceases as soon as the pump 44 stops. A drip of moistening agent onto the printing substrate web 1 is thus prevented.

In order to ensure the transfer of moistening agent onto the application rollers 28 or 29, it is appropriate to bear the application element 30 or 31 on a second linkage lever 46 or 47 that, for its part, is positioned in the housing 34. The suspension of application roller 28 or 29 and application element 30 or 31 can thus be such that the movement direction of the application roller 28 or 29 relative to the printing substrate web 1 and the movement direction of the application element 30 or 31 relative to the application roller 28 or 29 are approximately perpendicular to one another. The contact pressure of the application roller 28 or 29 on the printing substrate web 1 and of the application element 30 or 31 on the application roller 28 or 29 is then decoupled and independently adjustable. In order to ensure a reliable transfer of the moistening agent onto the application roller 28 or 29, a force can engage at the second linkage lever 46 or 47 in the direction of the application roller 28 or 29. This force can be realized via a spring 48 or 49 or another force element.

Via the force elements that engage on the application rollers 28 or 29 with an uneven preliminary tension a uniform pressure can be exerted on the printing substrate web 1 when the printing substrate web 1 is asymmetrically guided. The second moistening device 26 can naturally also only be used for lubrication of the printing substrate 1 in order to improve its sliding characteristics (FIG. 1). Only the lubricant is then supplied to it.

The cooling device KE can be realized as a function module via cooling rollers 6, 7 that is designed hollow and through which cooling air is conducted. Then the printing substrate web 1 is directed over the cooling rollers 6, 7 this are cooled. Two cooling rollers 7 can be arranged fixed, and one cooling roller 6 can be movable that can be shifted upwards to both remaining cooling rollers 7 in order to achieve a level path for the printing substrate web (main transport route).

The lubrication device SE can either be combined with the moistening device BE (FIG. 2) or can be arranged separate after the cooling device KE or in the cooling device KE adjacent to the last cooling roller. In the latter case, the lubrication device SE can be realized as this is shown in FIG. 9 through 11.

The discharge device AE can be realized as it is shown in FIG. 3 and is described. However, it is not situated at the output of the buffer device PE, but rather appropriately at the output of the multifunction device MFE.

While preferred embodiments have been illustrated and described in detail in the drawings and foregoing description, the same are to be considered as illustrative and not restrictive in character, it being understood that only the preferred embodiments have been shown and described and that all changes and modifications that come within the spirit of the invention both now or in the future are desired to be protected.

We claim as our invention:

1. A multifunction device for post-processing of a printing substrate web printed by a printing station of an electrophotographic printing device, comprising after the printing station of the printing device in succession viewed in a transport direction of the printing substrate web at least the following:

a buffering device for the printing substrate web;

at an exit of the buffering device a smoothing device having a first smoothing roller in direct contact with a first surface of the printing substrate web and a second smoothing roller in direct contact with a second surface opposite the first surface of the printing substrate web;

at an exit of the smoothing device a directly following moistening device applying a moistening agent for the printing substrate web;

at an exit of the moistening device a cooling device for the printing substrate web;

a discharge device for the printing substrate web after the cooling device; and a lubrication device adding a lubricant in addition to the moistening agent for the printing substrate web before the discharge device.

2. A multifunction device of claim 1 wherein the lubrication device is arranged at an exit of the cooling device.

3. A multifunction device of claim 1 wherein the lubrication device is integrated within the moistening device.

4. A multifunction device of claim 1 wherein the buffering device, the smoothing device, the moistening device, the cooling device, or the lubrication device are deactivatable without being removed from the multifunction device.

5. A multifunction device of claim 4 wherein deflection rollers are provided, said deflection rollers being positioned to move the printing substrate web either along a main transport route through the multifunction device or when a respective buffering, smoothing, moistening cooling, or lubrication device is activated position the web to a function position for the respective activated buffering, smoothing, moistening, cooling, or lubricating device displaced from the main transport route.

6. A multifunction device of claim 1 wherein deflection rollers are provided comprising cooling rollers, and the lubrication device is arranged at the exit of the cooling device such that the printing substrate web is initially directed over the deflection rollers and then passes by the lubrication device.

7. A multifunction device of claim 1 wherein said buffering device comprises:

at least one moveable operating device having a loop of the printing substrate web partially surrounding said movable operating device; and at least one sensor scanning the loop and that emits sensor signals indicating a length of the loop.

8. A multifunction device of claim 7 wherein said discharge device conveys the printing substrate web with a continuous speed from the buffering device and is controlled by the sensor signals of the sensor.

9. A multifunction device of claim 7 wherein said at least one movable operating device comprises at least one moveable dancing roller.

10. A multifunction device of claim 7 wherein said at least one movable operating device comprises two dancing rollers rigidly coupled with one another.

11. A multifunction device of claim 1 in which first, second, and third sensors are arranged along a loop of the printing substrate web in the buffering device , said first, second, and third sensors being positioned so that:

the first sensor indicates whether the buffering device is empty;

the second sensor indicates whether the loop of the printing substrate web is in a desired position; and the third sensor indicates whether the buffering device is full.

12. A multifunction device of claim 11 in which a buffer controller is provided to which sensor signals from the first, second, and third sensors are supplied and which controls the discharge device such that the loop fluctuates around said desired position.

13. A multifunction device of claim 12 in which the buffer controller controls the discharge device such that the multifunction device:

operates with higher speed when the third sensor indicates that the buffering device is full, and operates with said higher speed until the second sensor indicates that the loop is in the desired position;

operates with lower speed when the first sensor indicates that the buffering device is empty, and further operates with this speed until the second sensor indicates that the loop has reached the desired position; and operates with average speed when the second sensor indicates that the loop is in the desired position.

14. A multifunction device according to claim 12 in which the buffer controller controls the discharge device such that the multifunction device operates with average initial speed, dependent on an operating mode of the printing device, when the loop reaches the desired position;

given an under-run of the desired position by the loop in a direction towards the third sensor, the speed is increased until the loop crosses the desired position in a direction towards the first sensor, and then the speed is lowered again; and maintains as an average operating speed for the multifunction device a speed at which a duration in which the loop is located over the desired position coincides with a duration in which the loop is located below the desired position.

15. A multifunction device according to claim 12 in which the buffer controller controls the discharge device such that, after a start of the printing device, the discharge device operates after a delay with a speed that corresponds to an average starting speed.

16. A multifunction device of claim 11 in which said first, second, and third sensors comprise light barriers.

17. A multifunction device of claim 1 wherein said moistening device applies on the printing substrate web said moistening agent comprising a moistening fluid and said lubricant dissolved therein.

18. A multifunction device of claim 17 wherein the moistening fluid comprises water.

19. A multifunction device of claim 17 in which the lubricant comprises silicon oil.

20. A multifunction device of claim 17 in which the lubricant comprises an emulsion based on a silicon oil.

21. A multifunction device according to claim 20 in which an additive is mixed with the silicon oil.

22. A multifunction device according to claim 21 in which said additive comprises at least one of a wax and a polymer.

23. A multifunction device of claim 17 in which the lubricant comprises an emulsion based on at least one of mineral, vegetable, and synthetic oils.

24. A multifunction device according to claim 23 in which said emulsion comprises a metal processing cooling lubricant.

25. A multifunction device of claim 17 in which a proportion of the lubricant in the moistening agent is dependent on the printing substrate web.

26. A multifunction device of claim 1 in which the moistening device comprises a spray which is adjacent to the printing substrate.

27. A multifunction device of claim 1 in which the moistening device comprises a first spray on a first side of the printing substrate web and a second spray on an opposite side of the printing substrate web.

28. A multifunction device of claim 1 in which the moistening device comprises a roller arrangement with at least one application roller arranged on one side of the printing substrate web and which is pressed onto the printing substrate web, an application element associated with the application roller that is pivotable onto the application roller and transfers said moistening agent onto the application roller, and a counter element on a side of the printing substrate web opposite the application roller.

29. A multifunction device of claim 28 in which the counter-element comprises a further application roller with an associated further application element.

30. A multifunction device of claim 28 in which the application roller is freely movable.

31. A multifunction device according to claim 28 in which a pivoting device of the application roller at the printing substrate web and a pivoting device of the application element at the application roller are approximately perpendicular to one another.

32. A multifunction device according to claim 28 in which the application roller is borne on a first linkage lever that is positioned on a housing such that the application roller can execute a pivot movement towards the printing substrate web, and a first pressure element that exerts a force on the first linkage lever and thus on the application roller in a direction towards the printing substrate web is arranged between the housing and said first linkage lever.

33. A multifunction device according to claim 32 in which the application element is borne on a second linkage lever that is positioned on the housing so that the application element can execute a movement in a direction towards the application roller given movement of the second linkage lever, and a second pressure element that exerts a force on the second linkage lever and thus on the application element in the direction towards the application roller is arranged between the housing and the second linkage lever.

34. A multifunction device according to claim 33 in which respective forces of the first and second pressure elements are individually adjustable.

35. A multifunction device according to claim 33 in which the first and second pressure elements comprise respective springs.

36. A multifunction device according to claim 28 in which the application roller and the application element each have a width corresponding to a width of the printing substrate web, and respective linkage levers on which pressure elements engage being provided, the application roller and the application element each being borne at both opposite ends on the respective linkage levers on which the respective pressure elements engage.

37. A multifunction device according to claim 28 in which the application element comprises a feedthrough and a distributor channel with a distributor gap facing towards the application roller.

38. A multifunction device according to claim 37 in which the distributor gap is narrowed in comparison with the distributor channel such that the moistening agent is substantially evenly applied onto the application roller.

39. A multifunction device according to claim 37 in which a conveying system that supplies the moistening agent to the application element is connected to the feedthrough.

40. A multifunction device according to claim 39 in which the conveying system is arranged below the application element.

41. An electrographic printing device, comprising:

a printing station printing images on a printing substrate web;

after an output of the printing station a multifunction device receiving the printing substrate web; and said multifunction device comprising in succession a buffering device for the printing substrate web, at an exit of the buffering device a smoothing device having a first smoothing roller in direct contact with a first surface of the printing substrate web and a second smoothing roller in direct contact with a second surface opposite the first surface of the printing substrate web, at an exit of the smoothing device a directly following moistening device applying a moistening agent for the printing substrate web, at an exit of the moistening device a cooling device for the printing substrate web, a discharge device for the printing substrate web after the cooling device, and a lubrication device applying a lubricant in addition to the moistening agent for the printing substrate web before the discharge device.

42. A device of claim 41 wherein the lubrication device is arranged at an exit of the cooling device.

43. A device of claim 41 wherein the lubrication device is within the moistening device.

44. A device of claim 41 wherein the buffering device, the smoothing device, the moistening device, the cooling device, or the lubrication device are deactivatable without being removed from the multifunction device and when deactivated do not influence the remaining ones of the buffering, smoothing, moistening, cooling, and lubrication devices.

45. A device of claim 41 wherein a fixing station fixing toner images on the printing substrate web follows the printing station and said multifunction device follows said fixing station.

46. A method for post-processing of a printing substrate web printed by a printing station of an electrographic printing device wherein in a transport direction of the printing substrate web after leaving the printing station in succession performing the steps of:

buffering the printing substrate web with a buffering device;

smoothing the printing substrate web in a smoothing device having a first smoothing roller in direct contact with a first surface and a second smoothing roller in direct contact with a second surface opposite to the first surface of the printing substrate web after the buffering device;

moistening the printing substrate web with a moistening device applying a moistening agent directly following after the smoothing device;

cooling the printing substrate web with a cooling device after the moistening device;

discharging the printing substrate web with a discharge device after the cooling device; and lubricating the printing substrate web with a lubrication device applying a lubricant in addition to said moistening agent before the discharge device.

47. A method of claim 46 wherein the lubrication device is arranged at an exit of the cooling device.

48. A method of claim 46 wherein the lubrication device is integrated within the moistening device.

49. A method according to claim 46 in which movable and fixed deflection rollers are provided, and the printing substrate web is directed over the movable deflection rollers and the fixed deflection rollers arranged in the buffering, smoothing, moistening, cooling, and lubrication devices;

the fixed deflection rollers are arranged in a main transport route leading across the buffering, smoothing, moistening, cooling, and lubrication devices in the multifunction device; and the movable deflection rollers being shiftable into an operating position in which the printing substrate web is directed to the respective buffering, smoothing, moistening, cooling, or lubrication device, and are shiftable into a rest position in which, with the fixed deflection rollers, the movable deflection rollers form said main transport route for the printing substrate web.

50. A method according to claim 49 in which the movable deflection rollers are shifted into the rest position from the operating position to change the printing substrate web;

the printing substrate web is then changed; and subsequently the movable deflection rollers are again shifted into the operating position.

51. A method according to claim 49 in which the movable deflection rollers are shifted into the rest position to deactivate the respective buffering, smoothing, moistening, cooling or lubrication devices.

52. A method according to claim 46 wherein said moistening device applies said moistening agent made from a moistening fluid and said lubricant on the printing substrate web, said lubricant being dissolved in said moistening fluid.

53. A method according to claim 46 wherein the buffering device has at least one operating device, an operating force of which acts on the printing substrate web in order to form a loop of the printing substrate web, a sensor scans the loop and emits sensor signals indicating a length of the loop, and the discharge device is controlled by the sensor signals to convey the printing substrate web with continuous speed from the buffering device.

54. A method according to claim 53 in which dependent on the sensor signals, a buffer controller regulates the discharge device such that the loop of the printing substrate web, independent of a speed of supply of the printing substrate web into the buffering device in an adjusted state, always fluctuates around a desired position.

55. A method according to claim 53 in which a buffer controller regulates the discharge device dependent on sensor signals emitted by first, second, and third sensors arranged at a loop in the buffering device, and such that the discharge device:

operates with higher speed when the third sensor indicates with a third sensor signal that the buffering device is full, and maintains said higher speed until the second sensor indicates with a second sensor signal that the loop has achieved a desired position;

operates with lower speed when the first sensor indicates with a first sensor signal that the buffering device is empty, and maintains said lower speed until the second sensor indicates with the second sensor signal that the loop has reached the desired position; and operates with average speed, dependent on an operating mode of the printing device, when the second sensor indicates that the loop is in the desired position.

56. A method according to claim 46 in which a buffer controller regulates the discharge device such that upon reaching a desired position of a loop in the buffering device, the printing substrate web is operated by the discharge device with average initial speed, dependent on an operating mode of the printer;

providing a sensor and another sensor at the loop, and given an under-run of the desired position by the loop in a direction towards the sensor of the loop, speed is increased by the discharge device until the loop crosses the desired position in a direction towards said another sensor at the loop, and then the speed is lowered again; and the discharge device maintains as an average operating speed a speed at which a duration in which the loop is located over the desired position coincides with a duration in which the loop is located below the desired position.

57. A method according to claim 46 in which a buffer controller regulates the discharge device such that, after a start of the printing device, the discharge device operates after a delay with a speed that corresponds to an average initial speed.

58. A multifunction device for post-processing of a printing substrate web printed by a printing station of an electrophotographic printing device, comprising after the printing station:

a buffering device for the printing substrate web, a smoothing device having a first smoothing roller in direct contact with a first surface of the printing substrate web and a second smoothing roller in direct contact with a second surface opposite the first surface of the printing substrate web, a moistening device applying a moistening agent for the printing substrate web directly following the smoothing device, a cooling device for the printing substrate web, a lubrication device applying a lubricant in addition to said moistening agent for the printing substrate web, a discharge device for the printing substrate web, and the buffering device, the smoothing device, the moistening device, the cooling device, and the lubrication device each being separately deactivatable without being removed from the multifunction device and when deactivated do not influence a function of the remaining ones of the buffering, smoothing, moistening, cooling, and lubrication devices.

59. A multifunction device of claim 58 wherein web guide members are utilized which selectively deactivate the buffering, smoothing, moistening, cooling, or lubrication devices by changing a path through the respective buffering, smoothing, moistening, cooling, or lubrication device to a function position deviating from a main transport route when the buffering, smoothing, moistening, cooling or lubrication device is activated and by changing the path back to the main transport route when the buffering, smoothing, moistening, cooling or lubrication device is deactivated.

60. A method for post-processing of a printing substrate web printed by a printing station of an electrographic printing device, wherein after the printing station comprising the steps of:

buffering the printing substrate web with a buffering device;

smoothing the printing substrate web with a smoothing device having a first smoothing roller in direct contact with a first surface and a second smoothing roller in direct contact with a second surface opposite the first surface of the printing substrate web;

moistening the printing substrate web with a moistening device applying a moistening agent directly following the smoothing device;

cooling the printing substrate web with a cooling device;

discharging the printing substrate web with a discharge device;

lubricating the printing substrate web with a lubricating device applying a lubricant in addition to said moistening agent before the discharge device; and selectively deactivating the buffering device, the smoothing device, the moistening device, the cooling device, or the lubricating device without removing the respective buffering, smoothing, moistening, cooling, or lubricating device from the multifunction device, and wherein the deactivated buffering, smoothing, moistening, cooling or lubricating devices do not influence a function of remaining ones of the buffering, smoothing, moistening, cooling, and lubrication devices which are not deactivated.

61. A method of claim 60 wherein for the deactivation of a respective buffering, smoothing, moistening, cooling, or lubrication device, a path of the printing substrate web through the respective buffering, smoothing, moistening, cooling, or lubrication device is altered from a function position when the respective buffering, smoothing, moistening, cooling, or lubrication device is activated to a main printing substrate web path when the buffering, smoothing, moistening, cooling, or lubrication device is deactivated.

* * * * *